US010208513B2

(12) United States Patent
Crawford

(10) Patent No.: US 10,208,513 B2
(45) Date of Patent: Feb. 19, 2019

(54) IMMOBILIZATION DEVICE FOR STEERING SYSTEM OF MARINE OUTBOARD MOTORS

(71) Applicant: Joe Crawford, Moundville, AL (US)

(72) Inventor: Joe Crawford, Moundville, AL (US)

( * ) Notice: Subject to any disclaimer, the term of this patent is extended or adjusted under 35 U.S.C. 154(b) by 0 days.

(21) Appl. No.: 15/653,250

(22) Filed: Jul. 18, 2017

(65) Prior Publication Data

US 2018/0016816 A1 Jan. 18, 2018

Related U.S. Application Data

(60) Provisional application No. 62/363,685, filed on Jul. 18, 2016.

(51) Int. Cl.

| | |
|---|---|
| ***E05B 73/00*** | (2006.01) |
| ***B63G 13/00*** | (2006.01) |
| ***B63B 35/00*** | (2006.01) |
| ***B63B 17/00*** | (2006.01) |
| ***B63H 20/12*** | (2006.01) |
| ***B63H 20/36*** | (2006.01) |
| *B63H 20/00* | (2006.01) |

(52) U.S. Cl.

CPC ..... *E05B 73/0076* (2013.01); *B63B 17/00* (2013.01); *B63B 35/00* (2013.01); *B63G 13/00* (2013.01); *B63H 20/12* (2013.01); *B63H 20/36* (2013.01); *B63H 20/00* (2013.01)

(58) Field of Classification Search

CPC ..... B63H 20/00; B63H 20/08; B63H 5/125; B63B 17/00; B63B 35/00; B63G 13/00

USPC ..... 440/53, 55

See application file for complete search history.

(56) References Cited

U.S. PATENT DOCUMENTS

| | | | |
|---|---|---|---|
| 3,584,595 | A | 6/1971 | Perry et al. |
| 5,609,506 | A | 3/1997 | Williams, Jr. |
| 6,146,221 | A | 11/2000 | Natsume |
| 6,174,211 | B1 | 1/2001 | Nakamura |
| 6,283,806 | B1 | 9/2001 | Schmidt et al. |

OTHER PUBLICATIONS

Ranger Boats "Steer Stop Hydraulic Steering Lock" https://rangerwear.com/steer-stop-hydraulic-steerling-lock [Nov. 27, 2017 1:53:04 PM] 5 pages.

*Primary Examiner* — Lars A Olson

(74) *Attorney, Agent, or Firm* — Jake M. Gipson; Stephen H. Hall; Bradley Arant Boult Cummings LLP

(57) ABSTRACT

An immobilization device for steering systems on marine motors. The device comprises a first and second member, each member having two opposite ends, a non-immobilizing fastener connecting the first member near one of its ends to the second member near one of its ends, and a compressing fastener connecting the first member near the other of its ends to the second member near the other of its ends. The compressing fastener operates to draw the first and second members closer together. The device may also be part of an immobilization system comprising at least one of the devices and a steering system having a steering shaft and a steering ram. The device is assembled around the steering shaft and the compressing fastener is capable of applying sufficient compressive force to resist the steering ram sliding along the steering shaft.

20 Claims, 2 Drawing Sheets

IMMOBILIZATION DEVICE FOR STEERING SYSTEM OF MARINE OUTBOARD MOTORS

CROSS-REFERENCE TO RELATED APPLICATIONS

This application cites the benefit of the filing date of U.S. Provisional Patent Application No. 62/363,685, filed Jul. 18, 2016. The contents of U.S. Provisional Patent Application No. 62/363,685 are incorporated herein by reference in their entirety.

BACKGROUND OF INVENTION

Many types of watercraft include an outboard motor as a means of propulsion. The outboard motor is typically installed on the transom, and more powerful models (higher performance or higher horsepower) frequently use a hydraulic steering system to control the angular rotation of the motor relative to the centerline of the watercraft. Many watercraft with outboard motors are stored and transported on trailers when not in use. When trailing, the watercraft and outboard motor may be subject to significant vibrations and jarring due to irregularities and obstacles in the road. In particular, if the steering system is not immobilized when trailering, the outboard motor may become uncentered, and the weight of the outboard motor may encourage the motor to turn to the most extreme angular position. This rotation of the outboard may cause damage to the steering system, the outboard, or the watercraft. Thus, to protect the outboard motor and watercraft from damage, it is desirable to have a device to immobilize the steering system of the outboard motor.

Various prior art systems exist that immobilize the steering systems of outboard motors, but their solutions are imperfect. For instance, one type of prior art system is commonly referred to as a "motor toter." Ordinarily, these devices are designed to immobilize the steering system and also maintain the motor in a tilted position (which ensures clearance from the ground and relieves pressure on the tilt/trim system of the outboard). These devices usually attach in one of two ways. The first group is described as a "transom saver" and ordinarily comprises an elongated, rigid member that attaches to both the trailer and the lower unit of the outboard motor. The second group consists of rigid devices that connect to the motor's transom bracket and midsection, which immobilizes the steering system and maintains the motor in a tilted position. The "MotorMate" is a common example of a such a device. Both types of devices suffer from common problems, however. The motor toter of either design may become detached from the motor or trailer. When this occurs, for instance, due to significant jarring of the trailer over an irregular road, the motor toter may become loose and cause significant damage to the outboard motor, the watercraft, or the trailer. In addition, the steering system will no longer be restrained if this happens, and the motor may then rotate to its most extreme position, potentially causing damage to the steering system and motor. These devices are also cumbersome to install, often requiring that the outboard be aligned almost exactly at its center position, and the devices must be stored elsewhere when not in use, such as in the watercraft or a vehicle.

Other prior art systems include large plastic or rubber "clips" that install on the cylinder rod (alternatively referred to as the steering shaft) of the hydraulic steering system. These clips come in pairs, with each being clipped on the cylinder rod on opposite sides of the hydraulic steering ram.

Ordinarily, each clip has a length that is slightly less than half of the length of the exposed cylinder rod (i.e. the length of the cylinder rod minus the length of the steering ram). Thus, the steering ram must be at approximately the center position before installing the clips, and once installed, the clips prevent angular rotation of the motor. These devices, however, can be tedious to install because they require precise alignment of the motor before both clips will fit on the opposite sides of the cylinder rod, and they also can become wedged in place if the motor rotates slightly to one side. In addition, these devices must be completely removed from the cylinder rod and stored when the motor is in use. This can lead to lost or misplaced clips, which is problematic if the watercraft must be trailered with no other means to immobilize the steering system.

Consequently, there exists a long-felt need in the art for an immobilization device for steering systems on marine outboard motors that is easy to install, simple to disengage, and convenient to store.

DETAILED DESCRIPTION

An immobilization device for steering systems on marine outboard motors or marine inboard/outboard motors has been developed. For ease of understanding, reference in this disclosure is ordinarily to the structure of the steering systems in outboard motors, but as one of ordinary skill in the art will understand, the relevant structures of inboard/outboard motors are essentially the same and the teachings disclosed herein may be advantageously applied to the steering systems for inboard/outboard motors. The immobilization device installs around the steering shaft (also referred to as the cylinder rod) of a typical hydraulic steering system by tightening it onto the shaft, but the device may also be used on other types of steering systems. When the immobilization device is tightened around the shaft, the device provides a compressive force around the shaft. That force provides resistance to sliding along the shaft, such as when pressure is applied to the device from the steering ram when, for instance, the motor is bouncing during trailering. Thus, if two devices are installed and tightened onto each side of the steering ram, the devices prevent the steering ram from sliding along the steering shaft and therefore prevent the motor from experience angular rotation. In addition, when the outboard is being prepared for operation, the immobilization devices can be loosened, slid to the ends of the steering shaft, and tightened in place to prevent interference with the normal operation of the outboard and steering system. Accordingly, the immobilization device as more fully described below has the advantages that it is easy to install, simple to disengage, and convenient to store.

Figure 1:
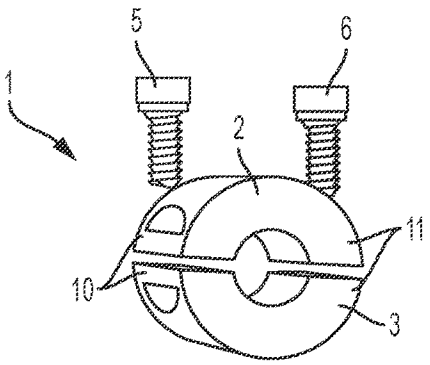
FIG. 1: A perspective view of an embodiment of the steering immobilization device.

In one embodiment of the immobilization device, the immobilization device 1 comprises a first member 2 and a second member 3. The members 2, 3 may have any suitable shape. In some embodiments, the members 2, 3 are mirror images of each other, but in other embodiments the members 2, 3 have different shapes. In a particular embodiment, the first or second member 2, 3 is a semi-circular arc of a ring, as shown in FIG. 1. In some embodiments, the members 2, 3 have an internal surface 4 with a contour that is complementary to the shape of a steering shaft 30. For example, in embodiments where the steering shaft 30 is cylindrical, the internal surface 4 has a rounded contour, and in specific embodiments, the contour is circular. In a particular embodiment for use with steering systems that have a ¾ inch shaft, the members 2, 3 have an internal surface 4 having a circular shape with approximately a ¾ inch diameter. In other embodiments, the members 2, 3 have an internal surface 4 having a circular shape with approximately a ½ inch or ⅝ inch diameter, which may be advantageous for applications involving inboard/outboard motors. Members 2, 3 having an internal surface 4 having a circular shape with other diameters may be used, and in some embodiments, the diameter will be approximately equal to the diameter of the shaft 30. In other embodiments, however, the internal surface 4 has other shapes, such as an elliptical or oval shape. One of ordinary skill in the art will understand that other shapes may be combined and advantageously used. For instance, a member 2, 3 may have a shape consisting essentially of a rectangular prism with an inner surface 4 having a circular shape.

By varying the shape of the internal surface 4 with respect to the shape of the steering shaft 30, the surface area of the members 2, 3 that contact the steering shaft 30 can be increased or decreased, thereby increasing or decreasing the friction between the device 1 and the shaft 30. Greater friction generally means that the device 1 will more readily resist sliding along the shaft 30 under greater forces.

The first and second members 2, 3 may be constructed from any suitable material. In specific embodiments, the members 2, 3 are constructed from type 304 stainless steel, which may be desirable for use in freshwater applications. In other embodiments, the members 2, 3 are constructed from type 316 stainless steel, which may be desirable for use in saltwater applications. Other materials may be used, however, including other metal alloys and plastics. In some embodiments, the selected material preferable has a hardness that is less than the hardness of material comprising the steering shaft 30, which lessens the chance that the device 1 may scratch or damage the shaft 30.

Each member 2, 3 has a first end 10 and a second end 11. The members 2, 3 are connected together near each end 10, 11 by non-immobilizing fasteners 5, at least one of which is a compressing fastener 6. The term non-immobilizing fastener 5 refers to a fastener that allows movement of the first member 2 relative to the second member 3; in other words, a non-immobilizing fastener does not permanently and immobily connect the first and second members 2, 3. A non-immobilizing fastener 6 may be fastener that inherently allows some movement (such as a hinge), or it may be a fastener that can be manipulated to allow movement of the members 2, 3 (as in the case of loosening a screw or bolt). A weld is an example of a fastener that is not an non-immobilizing fastener. The term compressing fastener 6 as used herein is a fastener that compresses the first and second members 2, 3 together. A screw and a lever clamp are examples of compressing fasteners 6, whereas a hinge itself is not a compressing fastener 6. (A hinge may cooperate with a lever or adjustable buckle to provide a compressive closure.) As can be seen from the foregoing examples, the non-rigid fastener 5 and the compressing fastener 6 are not mutually exclusive types of fasteners, and in some embodiments, the non-rigid fastener 5 and the compressing fastener 6 are the same type of fastener (i.e. a screw).

The non-immobilizing fastener 5 can be any suitable fastener, and the first and second members 2, 3 may include a structure to accommodate the non-immobilizing fastener 5. The non-immobilizing fastener 5 may be a removable or non-removable fastener, and examples of non-immobilizing fasteners 5 include a hinge, a screw, a bolt and nut, or a rivet. In a specific embodiment, the non-immobilizing fastener 5 is a screw, and at least the first or second member 2, 3 is threaded to accommodate the screw. In some embodiments, the screw is a socket cap screw, but in other embodiments the screw may be a phillips screw or a slotted screw. The non-immobilizing fastener 5 may be constructed from any suitable material, such as a metal alloy. In a specific embodiment, the non-immobilizing fastener 5 is constructed from type 304 stainless steel or type 316 stainless steel.

The compressing fastener 6 can be any suitable fastener capable of providing sufficient compression to prevent the device 1 from sliding along the steering shaft 30 due to forces associated with the motor while trailering. The first and second members 2, 3 may include a structure to accommodate the compressing fastener 6. The compressing fastener 6 is ordinarily a removable fastener, which can be removed to place the device 1 around the steering shaft 30 and then reinstalled. However, in embodiments where the non-immobilizing fastener 5 is removable, the compressing fastener 6 may be non-removable. In addition, in some embodiments where the device 1 is permanently installed on the shaft 30 (i.e. cannot be removed from around the shaft 30 without disassembling the steering system), both the compressing fastener 5 and the non-imobilizing fastener 6 may be non-removable. Examples of a compressing fastener 6 include a screw, a bolt and nut, or a lever clamp.

Figure 2:
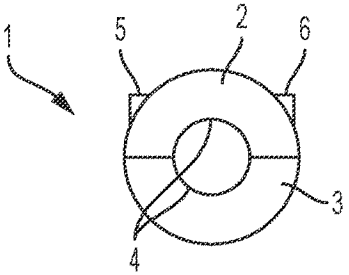
FIG. 2: An elevational view of an embodiment of the steering immobilization device.

The desirable compressive force of the compressing fastener 6 will vary based on a variety of factors, including the weight of the outboard, the size and shape of the steering shaft 30, and the size and shape of the device 1. In some embodiments, the compressing fastener 6 is capable of applying at least 500 lbs (227 kg) of compressive force. In other embodiments, the compressing fastener 6 is capable of applying at least 1,500 lbs (680 kg) of compressive force. This embodiment may have the advantage that it may more readily resist sliding, particularly when used with larger or heavier outboards. In other embodiments, the compressing fastener 6 is capable of applying at least 2,000 lbs (907 kg) of compressive force. And in yet other embodiments, the compressing fastener 6 is capable of applying at least 2,500 lbs (1134 kg) of compressive force. An example of such an embodiment is the device 1 shown in FIGS. 1-3, wherein the compressing fastener 6 is a screw, which has a maximum compressive force of about 3,000 lbs (1361 kg). Testing has suggested, however, that not all types of compressing fasteners 6 will provide sufficient compressive force to resist sliding along the steering shaft 30. For instance, a lever clamp of the type shown in FIGS. 5 and 6 was tested. This style of lever clamp has a maximum compressive force of about 100 lbs (45 kg) and was unable to resist sliding due to the forces associated with trailering. Nevertheless, this type of compressing fastener 6 could be improved to provide sufficient compressive force to resist sliding. Such an embodiment may be desirable because the lever on a lever clamp provides an easy means to tighten and loosen the fastener without the aid of additional tools.

Figure 6:
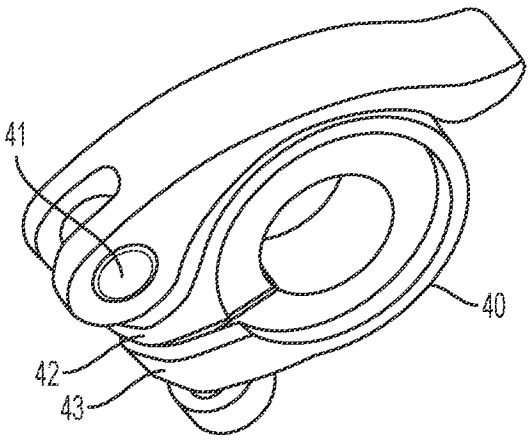
FIG. 6: A perspective view of a single-member embodiment of the steering immobilization device having a lever clamp, the lever clamp in the tightened position.
Figure 5:
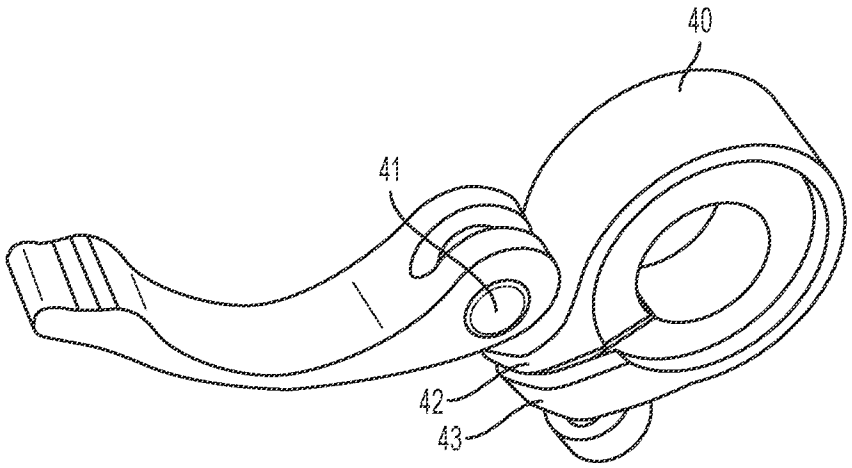
FIG. 5: A perspective view of a single-member embodiment of the steering immobilization device having a lever clamp, the lever clamp in a loosened position.

Alternatively, in some embodiments, the immobilization device comprises (a) a single member 40 that encases the steering shaft 30 and (b) a compressing fastener 41 connected to opposite ends of the single member 42, 43. An exemplary embodiment of this device is shown in FIGS. 5 and 6. In the single-member embodiment, the compressing fastener 41 may be removable so that device may be installed around the steering shaft 30, but in other embodiments where the device is permanently installed around the shaft 30, the compressing fastener 41 may be non-removable. The single member 40 is constructed from any suitable material, such as plastic or a metal alloy. In some embodiments, the single member 40 is preferably constructed from a flexible material, which allows the opposite ends 42, 43 to be pulled apart to slide the single member 40 onto the steering shaft 30. The compressing fastener 41 is constructed from any suitable material identified above, and in a specific embodiment the compressing fastener 41 is type 304 stainless steel or type 316 stainless steel.

A steering immobilization system preferably comprises a first immobilization device 1 and a second immobilization device 1, but in some embodiments, the system comprises a single immobilization device 1. In a particular embodiment, the steering immobilization system comprises a steering shaft 30 and at least one immobilization device 1. In this embodiment, the at least one immobilization device 1 may be removable or non-removable, but if the at least one device 1 is non-removable, the at least one device 1 is slidable so that the device 1 may slide along the shaft 30. Optionally, the at least one device 1 may be attached to the steering ram 31 so that the device 1 stays fixed relative to the steering ram 31 but allows the steering shaft 30 to slide along the device 1 when the compressing fastener 6 is not tightened.

To install a system with removable fasteners, the removable fastener (either the non-immobilizing fastener 5 or the compressing fastener 6) is removed from the first immobilization device 1, and the first immobilization device 1 is placed around the steering shaft 30 to one side of the steering ram 31. The removable fastener is then reinstalled, but not necessarily tightened, onto the first immobilization device 1. In systems comprising a second immobilization device 1, the steps are repeated except that the second immobilization device 1 is installed around the steering shaft 30 on the opposite side of the steering ram 31.

Figure 3:
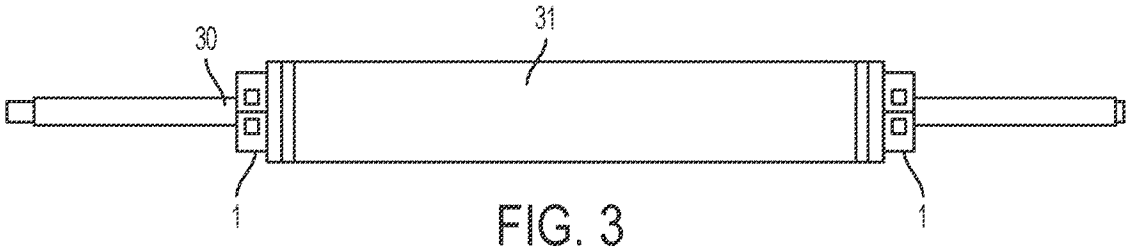
FIG. 3: A plan view showing a steering immobilization system comprising two steering immobilization devices installed on the steering shaft of a conventional hydraulic steering system and positioned to immobilize the steering ram.

To immobilize the steering system, the first device 1 should be slid to a position near the steering ram 31 and the compressing fastener 6 should be tightened to a suitable compressive force. In systems comprising a second device 1, the second device 1 should also be slid to a position near the opposite side of the steering ram 31, and the compressing fastener 6 should be tightened to a suitable compressive force. In some embodiments, the steering ram 31 is approximately centered on the steering shaft 30 before the first and second device 1 are tightened onto the shaft 30. But advantageously, the immobilization system can immobilize the steering system when the steering ram 31 is in any position along the steering shaft 30. FIG. 3 shows the location the first and second immobilization devices 1 relative to the steering ram 31 when the steering system is immobilized.

Figure 4:
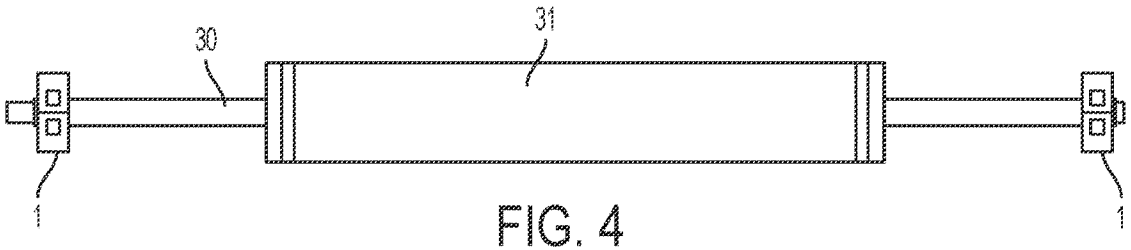
FIG. 4: A plan view showing a steering immobilization system comprising two steering immobilization devices installed on the steering shaft and positioned to allow operation of the steering ram.

To re-mobilize the steering system, the compressing fastener 6 of the first device 1 should be loosened until it relieves the compressive force on the steering shaft 30, but the compressing fastener 6 is not required to be removed. The first device 1 may then be slid near the end of the steering shaft 30, as shown in FIG. 4. The compressing fastener 6 may then be optionally tightened to maintain the first device 1 near the end of the steering shaft 30. In embodiments of the system comprising a second device 1, the process is repeated for the second device 1. As can be seen from the foregoing, the immobilization devices are only loosened to allow movement of the steering system and can be maintained on the steering shaft 30 while the outboard and steering system is in use.

While the invention has been described with respect to a limited number of embodiments, those skilled in the art, having benefit of this disclosure, will appreciate that other embodiments can be devised which do not depart from the scope of the invention as disclosed here.

I claim:

1. An immobilization device for steering systems on marine motors, the device comprising:

a) a first member, the first member having two opposite ends;

b) a second member, the second member having two opposite ends;

c) a first non-immobilizing fastener directly connecting the first member near one of its ends to the second member near one of its ends; and d) a second non-immobilizing fastener directly connecting the first member near the other of its ends to the second member near the other of its ends;

wherein at least one of the first and second non-immobilizing fastener is a compressing fastener that operates to draw the first member and the second member closer together, the compressing fastener capable of applying at least about 500 lbs of compressive force.

2. The device of claim 1, wherein the compressing fastener is capable of applying at least about 1,500 lbs of compressive force.

3. The device of claim 1, wherein the compressing fastener is capable of applying at least about 2,500 lbs of compressive force.

4. The device of claim 1, wherein the compressing fastener is capable of applying at least about 3,000 lbs of compressive force.

5. The device of claim 1, wherein both the first and the second non-immobilizing fastener are compressing fasteners.

6. The device of claim 1, wherein at least one of the first and second non-immobilizing fastener is a removable fastener.

7. The device of claim 1, wherein the first member has an internal surface having a semi-circular shape and the second member has an internal surface having a semi-circular shape.

8. The device of claim 7, wherein the internal surface of the first member has a diameter of approximately ¾ inch, and the internal surface of the second member has a diameter of approximately ¾ inch.

9. The device of claim 1, wherein the compressing fastener is selected from the group consisting of: a screw, a bolt, and a lever clamp.

10. The device of claim 1, wherein each of the first and second non-immobilizing fastener is selected from the group consisting of: a screw, a bolt, a lever clamp, a hinge, or a rivet.

11. The device of claim 5, wherein each of the compressing fasteners comprises a screw and is capable of applying at least 3,000 lbs of compressive force.

12. An immobilization system for marine motors, the system comprising:

a) a steering system for a marine motor, the steering system comprising a steering shaft and a steering ram; and b) at least one immobilization device assembled around the steering shaft, each immobilization device comprising:

i. a first member, the first member having two opposite ends;

ii. a second member, the second member having two opposite ends;

iii. a first non-immobilizing fastener directly connecting the first member near one of its ends to the second member near one of its ends; and iv. a second non-immobilizing fastener directly connecting the first member near the other of its ends to the second member near the other of its ends;

wherein at least one of the first and second non-immobilizing fastener is a compressing fastener that operates to draw the first member and the second member closer together around the steering shaft, the compressing fastener capable of applying sufficient compressive force to resist the steering ram sliding along the steering shaft.

13. The system of claim 12, the system comprising two immobilization devices, the two immobilization devices assembled around the steering shaft on opposite sides of the steering ram.

14. The system of claim 13, wherein the compressing fastener of each of the two immobilization devices is capable of applying at least about 500 lbs of compressive force.

15. The system of claim 13, wherein the compressing fastener of each of the two immobilization devices is capable of applying at least about 2,500 lbs of compressive force.

16. The system of claim 13, wherein the compressing fastener of each of the two immobilization devices is capable of applying at least about 3,000 lbs of compressive force.

17. A method for controlling the movement of a steering system for a marine motor, the steering system having a steering shaft and a steering ram, the method comprising:

a) placing a first immobilization device around the steering shaft on one side of the steering ram, wherein the first immobilization device comprises:

a first member, the first member having two opposite ends;

a second member, the second member having two opposite ends;

a first non-immobilizing fastener directly connecting the first member near one of its ends to the second member near one of its ends; and a second non-immobilizing fastener directly connecting the first member near the other of its ends to the second member near the other of its ends, wherein at least one of the first and second non-immobilizing fastener is a compressing fastener;

b) positioning the first immobilization device near the first end of the steering ram; and c) tightening the compressing fastener such that the first immobilization device compresses around the steering shaft and resists the steering ram from sliding along the steering shaft.

18. The method of claim 17, the method comprising the additional steps of:

a) placing a second immobilization device around the steering shaft on the opposite side of the steering ram, wherein the second immobilization device has at least one compressing fastener;

b) positioning the second immobilization device near the second end of the steering ram; and c) tightening the at least one compressing fastener of the second immobilization device such that the second immobilization device compresses around the steering shaft and resists the steering ram from sliding along the steering shaft.

19. The method of claim 18, the method comprising the additional steps of:

a) loosening the compressing fastener of the first immobilization device;

b) loosening the at least one compressing fastener of the second immobilization device; and c) sliding the first and second immobilization devices to near the respective ends of the steering shaft such that the steering ram may slide along the steering shaft.

20. The method of claim 17, wherein at least one of said first and second non-immobilizing fasteners is a removable fastener, the method comprising the additional steps of:

a) removing said removable fastener from at least one of said first and second members; and b) removing said immobilization device from said steering shaft without disassembling said steering system.

* * * * *